United States Patent [19]

Kondo

[11] 4,421,003

[45] Dec. 20, 1983

[54] ENVELOPE GENERATOR FOR ELECTRONIC MUSICAL INSTRUMENTS

[75] Inventor: Tatsunori Kondo, Iwata, Japan

[73] Assignee: Kabushiki Kaisha Kawai Gakki Seisakusho, Japan

[21] Appl. No.: 324,848

[22] Filed: Nov. 25, 1981

[30] Foreign Application Priority Data

| | | | |
|---|---|---|---|
| Nov. 25, 1980 | [JP] | Japan | 55-165721 |
| Apr. 30, 1981 | [JP] | Japan | 56-65710 |
| May 12, 1981 | [JP] | Japan | 56-71173 |
| May 30, 1981 | [JP] | Japan | 56-83006 |

[51] Int. Cl.[3] ..... G10H 1/02

[52] U.S. Cl. ..... 84/1.26; 84/1.13

[58] Field of Search ..... 84/1.26, 1.13, 1.01, 84/1.03, 1.19

[56] References Cited

U.S. PATENT DOCUMENTS

| | | | |
|---|---|---|---|
| 4,079,650 | 3/1978 | Deutsch et al. | 84/1.26 |
| 4,267,763 | 5/1981 | Futamase et al. | 84/1.26 |
| 4,332,183 | 6/1982 | Deutsch | 84/1.26 |

*Primary Examiner*—F. W. Isen

*Attorney, Agent, or Firm*—McGlew and Tuttle

[57] ABSTRACT

In the generation of an envelope waveshape of a musical note to be produced in response to a key depression, speed parameters of the envelope which are determined corresponding to the speed of its attack, decay and release are produced digitally. The envelope waveshape is obtained by calculations based on the speed parameters. The formation of the envelope waveshape of the musical note, its volume level control and its tone control can be achieved with simple arrangements.

15 Claims, 12 Drawing Figures

ENVELOPE GENERATOR FOR ELECTRONIC MUSICAL INSTRUMENTS

BACKGROUND OF THE INVENTION

1. Field of the Invention

The present invention relates to an envelope generator for electronic musical instruments which generates a wide variety of envelopes by controlling speed parameters representative of the speeds of attack, decay and release of an envelope and which has a reduced number of input terminals.

The present invention also pertains to an envelope generator for electronic musical instruments which is designed to form envelope waveshapes for various amplitude modulation effects and control their volume levels with a simple arrangement.

Further, the present invention also concerns an envelope control device for electronic musical instruments, and more particularly a system for controlling an envelope generator for generating an envelope waveshape through utilization of digital parameters.

2. Description of the Prior Art

Conventional systems for digitally generating an envelope are roughly divided into those of storing a waveshape and those of approximating a waveshape by functions.

In the case of generating many kinds of envelopes of different waveshapes such as an envelope for a sliding Formant filter for changing a harmonic coefficient of a musical note as described, for example, in U.S. Pat. No. 4,085,644, an envelope for amplitude modulation and so forth, the former systems call for a number of memories, and hence are uneconomical and the latter systems are mostly of the type controlling the oscillation frequency of a CR oscillator to provide timing for functional operations, so that they must be provided with oscillators corresponding to tones of many kinds of envelopes and the number of input terminals used also increases. Accordingly, it is inevitable at the present stage of this field that the conventional systems are appreciably restricted by limitations on their arrangements and costs. With a view to simplifying the system arrangement, there has been proposed a system that accumulates a selected one of digital numbers of one group by an accumulator to obtain envelope calculating timing from its multi-bit output, but this system still involves an appreciably complicated arrangement associated with the accumulator.

In the past, amplitude modulation effects have widely been adopted in electronic musical instruments; they are a repeat effect for repeatedly generating an attennated sound as in a marimba, banjo, mandolin or the like, a crescendo effect for causing a gradual increase in loudness in an ensemble of string instruments, an attack effect for placing special emphasis upon the rise-up portion of a sound and so forth. These effects are usually produced by the use of an analog multiplier but the analog multiplier has the defects of small dynamic range, poor signal-to-noise ratio, low response speed and the necessity of adjustment of correcting dispersion in the characteristics of individual elements. Such effects can also be produced by a digital multiplier but a complex circuit arrangment is needed; especially, each amplitude modulated signal must be produced by an independent circuit, presenting a problem of high manufacturing costs.

In the prior art, the envelope waveshape is determined dependent on the time constant of a CR circuit in an analog envelope generator or the magnitude of the oscillation frequency of a CR oscillator in a digital envelope generator. In the case of requiring many kinds of envelopes, however, it is necessary to prepare CR circuits or CR oscillators corresponding in number to the kinds of envelopes needed.

U.S. Pat. No. 3,952,623 has proposed a solution to such a problem. In this U.S. patent it is proposed to accumulate a scale factor by an accumulator and to utilize the resulting signal as envelope calculation timing, but this method requires an accumulator for timing generation.

Further, an analog variable resistor is employed in conventional electronic musical instrument for controlling an envelope waveshape or tone but, in a digital electronic musical instrument, the resistance value of this analog variable resistor is converted to digital form for use as a digital quantity. However, the data merely converted to digital form cannot be used as it is; since different data are provided according to changing characteristics of the analog variable resistors, it is necessary to convert the data to desired characteristics. For example, in Japanese Patent Laid Open Gazette No. 149614/79 (laid open Nov. 24, 1974) in the name of the assignee of this application, there is proposed, for synthesizing a harmonic coefficient corresponding a musical note, data obtained by A-D conversion of the voltage value of a variable resistor is further converted into desired data. But the method of unitarily converting the value of the variable resistor cannot be applied as it is to the envelope control. That is to say, the change characteristic of an attack VR (VR being a variable resistor) for controlling the rise time of an envelope and the change characteristic of a decay VR for controlling the fall time of the envelope differ with respect to the envelope time and, further, in the case of causing a change in the tone of the sound to be produced (a sliding Formant filter effect), another VR is required.

SUMMARY OF THE INVENTION

It is an object of the present invention to provide a simple-structured envelope generator for electronic musical instruments which is designed so that it is capable or arbitrarily setting envelope calculation timing to generate many kinds of envelopes and that the number of input terminals used is reduced.

Another object of the present invention is to provide a simple-structured envelope generator for electronic musical instruments which is capable of forming envelope waveshapes for various amplitude modulation effects and controlling volume levels.

Another object of the present invention is to provide a simple-structure envelope generator for electronic musical instruments which is adapted for the generation of an envelope of a multiple tone by a time-division calculation and simultaneous generation of envelopes of different waveshapes and envelopes for amplitude modulation effects.

Yet another object of the present invention is to provide a simple structured envelope generator for electronic musical instruments which performs control of an envelope waveshape, tone and volume level through the use of a variable resistance element.

To achieve a first one of the abovesaid object, the envelope generator of the present invention which generates an envelope of a musical note by calculating at predetermined timing, comprises means for digitally generating envelope speed parameters dependent on the speeds of the attack, decay and release of an envelope to be produced in response to a key depression; and calculating means for calculating an envelope waveshape based on the speed parameters.

To achieve a second one of the above said objects, the envelope generator of the present invention which has calculating means for calculating envelope data at predetermined timing based on speed parameters representing an envelope waveshape to be generated in response to a key depression, comprises memory means for temporarily storing envelope data for an amplitude modulation effect to be added to a predetermined envelope waveshape, multiplying means for selectively multiplying on a time divided basis the predetermined envelope data calculated by the calculating means, the envelope data for the amplitude modulation effect selected from the memory means and volume level data separately set according to each tone; and converting means for converting the calculation result of the multiplying means into musical waveshape data.

To achieve a third one of the abovesaid objects, the envelope generator of the present invention comprises first memory means for storing speed parameters representing an envelope waveshape to be generated in response to a key depression; second memory means for storing a signal for determining whether to control by a volume VR the rise or fall time of a sound to be produced; read means for reading out the speed parameters from the first memory means by the signal from the second memory means; and calculating means for calculating the shape of rise or fall of an envelope by the speed parameters on the time divided basis.

To achieve a fourth one of the abovesaid objects, the envelope generator of the present invention comprises means for generating digital data for controlling the envelope waveshape, the tone (sliding Formant or the like) and the volume level of a musical note to be produced; and a data converter for generating a selected one of data of different variation characteristics corresponding to each data from the above means in accordance with the timing of the envelope waveshape.

DESCRIPTION OF THE PREFERRED EMBODIMENTS

With reference to the drawings, the present invention will hereinafter be described in detail.

Figure 1:
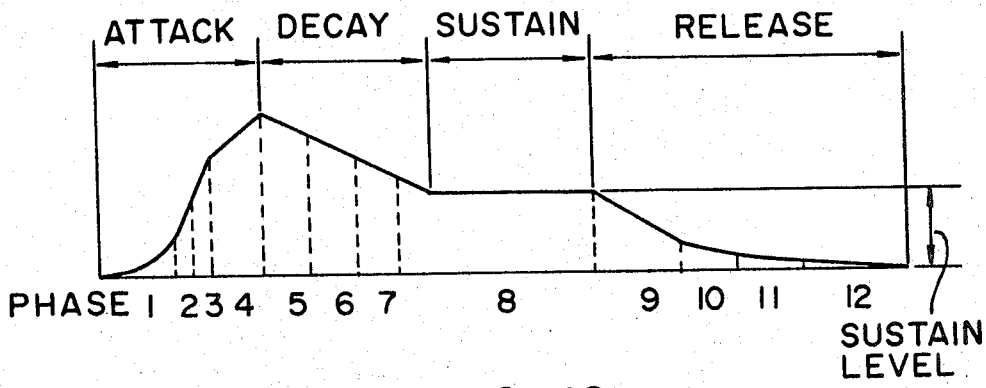
FIG. 1 is a diagram explanatory of the principle of an envelope generator of the present invention.

FIG. 1 is explanatory of the principle of the envelope generator of the present invention. In the present invention, an envelope is divided into a plurality of phases, for example, 12 phases as shown in FIG. 1.

An attack portion of the envelope is divided into phases 1 to 4. A decay portion is split into phases 5 to 8 and a key depression is stopped in the phase 8. A release portion is split into phases 9 to 12.

Envelope data is represented by a floating-point number and divided into an exponent (power) and a mantissa shown in Table 1.

TABLE 1

| Exponent | Decibel representation | Mantissa | Decimal representation |
|---|---|---|---|
| 000 | −0 dB | 000 | 1.000 |
| 001 | −6 dB | 001 | 1.125 |
| 010 | −12 dB | 010 | 1.25 |
| 011 | −18 dB | 011 | 1.375 |
| 100 | −24 dB | 100 | 1.5 |
| 101 | −30 dB | 101 | 1.625 |
| 110 | −36 dB | 110 | 1.75 |
| 111 | −42 dB | 111 | 1.875 |

For example, if a maximum value of the envelope is equal to or smaller than 1, a maximum level of the envelope is represented by an exponent "000" and a mantissa "000". Letting $1.00\times2^0$ be 0 dB, a minimum level of the envelope is by an exponent "111" and a mantissa "000" and represented by $1.00\times2^{-7}$ (−42 dB).

An exponential function characteristic of the envelope is provided through utilization of a feature of the floating point. That is, the decay and release portions can easily be formed by counting down the mantissa part and counting up the exponent part. The attack portion can be obtained by shifting data corresponding to the phases of the attack portion through the use of a binary shift circuit described later. The method of forming an envelope waveshape by representing its attack, decay, sustain and release portions by the binary floating-point number is disclosed, for example, in U.S. Pat. No. 4,144,789 issued in the name of the assignee of this application. Hence no detailed description will be given.

The most important point of the present invention is to represent the lengths of the attack, decay and release of an envelope waveshape by digital parameters and these parameters are effectively applied to envelope calculating means. The system of this calculating means is not limited specifically to a particular one.

Now, consider the release portion. In order that the length of the release may be change to 1 millisecond to 3 seconds, the release portion is discretely divided into, for example, 32 stages and the position of each stage is represented by five bits of the binary notation and it is provided as an envelope speed parameter to a speed parameter decoder to yield a value corresponding to SL×SC/RT, where SL is sustain level, SC is a system clock (a calculation time) and RT is a release time. The value thus obtained means displacement per calculation cycle included in the release time RT. That is, the release time of the envelope is dependent on this displacement. For example, if the displacement is small, the release time increases and if the former is large, the latter decreases.

Figure 2:
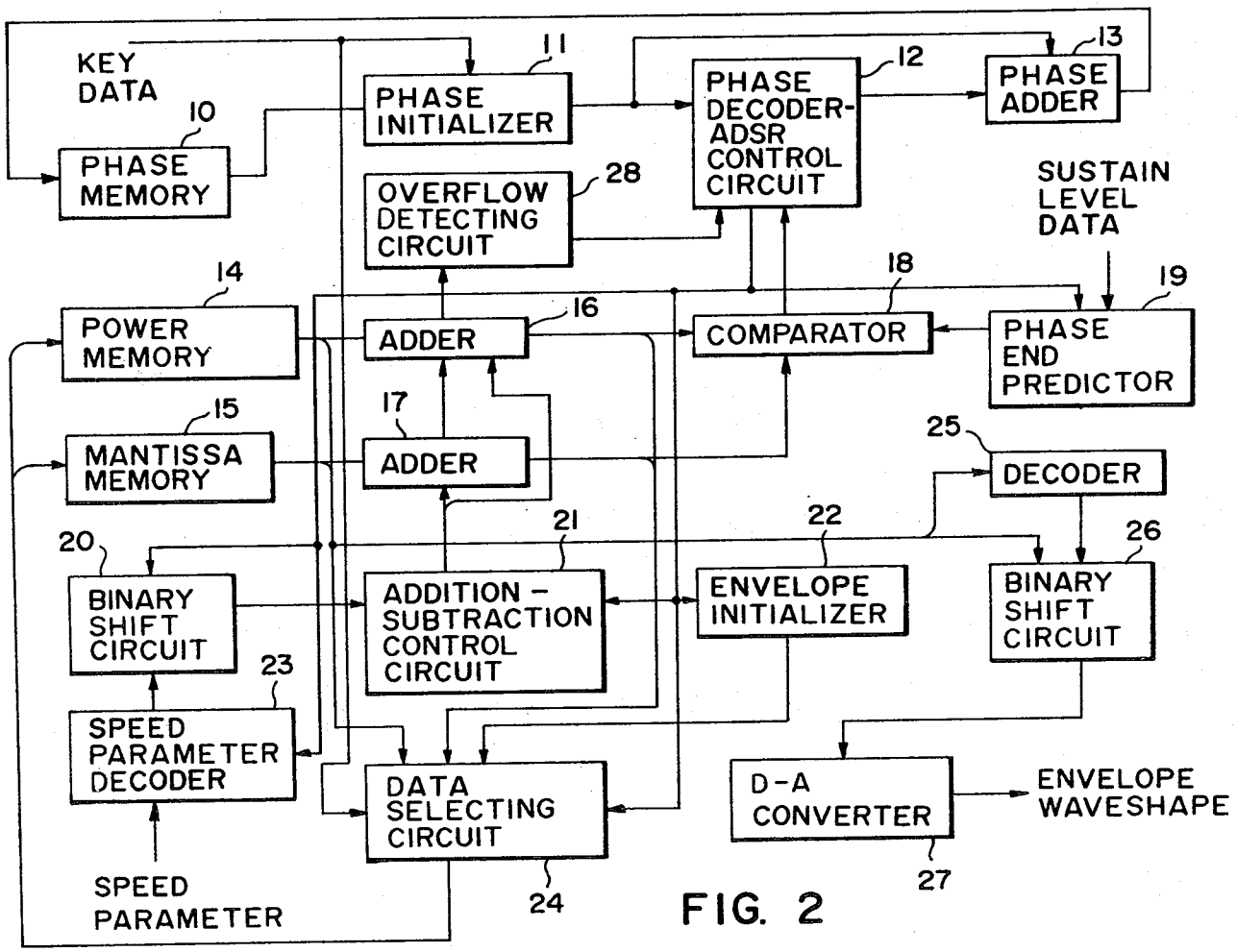
FIG. 2 is an explanatory of the arrangement of a first embodiment of the present invention, illustrating in a block form an envelope generating circuit in which speed parameters according to the present invention are applied to a circuit for calculating a floating point number.

FIG. 2 is explanatory of the arrangement of a first embodiment of the present invention, illustrating in block form an envelope generating circuit in which the above-said speed parameter is applied to a calculation circuit for the aforementioned floating-point number.

In FIG. 2, a phase initializer 11 responds to an input of key data to provide initial values of predetermined phases of an envelope described previously in respect of FIG. 1. The initial values are decoded by a phase decoder-ADSR control circuit 12 and employed for controlling phase shifts of predetermined circuits of the system. One of the circuits is a phase end predictor 19. In this case, sustain level data is applied to the phase end predictor 19, from which a predictive end value of each phase is provided to a comparator 18 for comparison with a value applied thereto from an arithmetic unit described later. When the latter coincides with or exceeds the former, a signal is applied to a phase adder 13 through the phase decoder-ADSR control circuit 12, wherein "1" is added to phase data. And the adder output is stored in a phase memory 10 and its read output is provided via the phase initializer 11 to the phase decoder-ADSR control circuit 12, starting the next phase.

A variable range (1 mS to 3 sec) of the fall time in the release or decay portion is discretely divided, for example, into 32 stages and the position of each stage is represented by a speed parameter of five bits. The speed parameter of a required position is applied to a speed parameter decoder 23, wherein it is decoded to yield the aforesaid value SL×SC/RT. A binary shift circuit 20 of the next stage is controlled by the phase decoder-ADSR control circuit 12. In the cases of release and decay, the decoder output passes through the binary shift circuit 20 without shifting it and is applied to an addition-subtraction control circuit 21. Under the control of the phase decoder-ADSR control circuit 12 the addition-subtraction control circuit 21 controls an addition and a subtraction which are conducted in the arithmetic unit. In the cases of release and decay, the addition-subtraction control circuit 21 serves to add exponents and subtract mantissas. Based on data from the addition-subtraction circuit 21, adders 16 and 17 of the arithmetic unit respectively adds and subtracts data which are read out from a power memory 14 and a mantissa memory 15 respectively having stored therein the exponents and the mantissas of Table 1 and the outputs from the adders 16 and 17 are provided to the comparator 18 and a data selecting circuit 24. In the comparator 18 the added exponent from the adder 16 and the subtracted mantissa from the adder 17 are compared with end value data in each phase which is provided from the phase end predictor 19 and the calculation is repeated until the added and subtracted outputs coincide with or exceed the predictive end value. That is to say, the exponent from the adder 16 and the mantissa from the adder 17 are provided to the data selecting circuit 24, from which these data are restored to the power memory 14 and the mantissa memory 15 by a control signal from the phase decoder-ADSR control circuit 12. In this way, the calculation is repeated for each phase to form a release or decay of a length corresponding to the parameter represented by the aforesaid five bits. The data selecting circuit 24 has another function such as follows: For example, in the case where the adder 16 overflows, it is detected by an overflow detecting circuit 20 and, instead of applying the aforesaid data (the calculated data) to the power memory 14 and the mantissa memory 15, the memory outputs are selectively provided or the next envelope initail value is derived from an envelope initializer 22.

In the case of attack, decoded data from the speed parameter decoder 23 is provided to the binary shift circuit 20. By shifting the binary shift circuit 20 in a manner to increase the data corresponding to the phases, an excellent attack waveshape can be obtained. For example, in the case of the phase 1, the data from the speed parameter decoder 23 is shifted to left by two bits, that is, the data is shifted so that it may become fourfold. In the phase 2, the data is shifted to left by one bit so that it may become twice; in the phase 3, the data is sent out without being shifted; and in the phase 4, the data is shifted to right by one bit so that it may become ½. By such shift operations, the attack waveshape shown in FIG. 1 is formed.

The data of the envelope thus formed are applied from the power memory 14 and the mantissa memory 15 to a decoder 25 and a binary shift circuit 26, wherein the data of the floating-point number shown in Table 1 are converted into digital data of an ordinary fixed-point number, which are applied to a D-A converter 27, obtaining therefrom an analog envelope waveshape.

Figure 3:
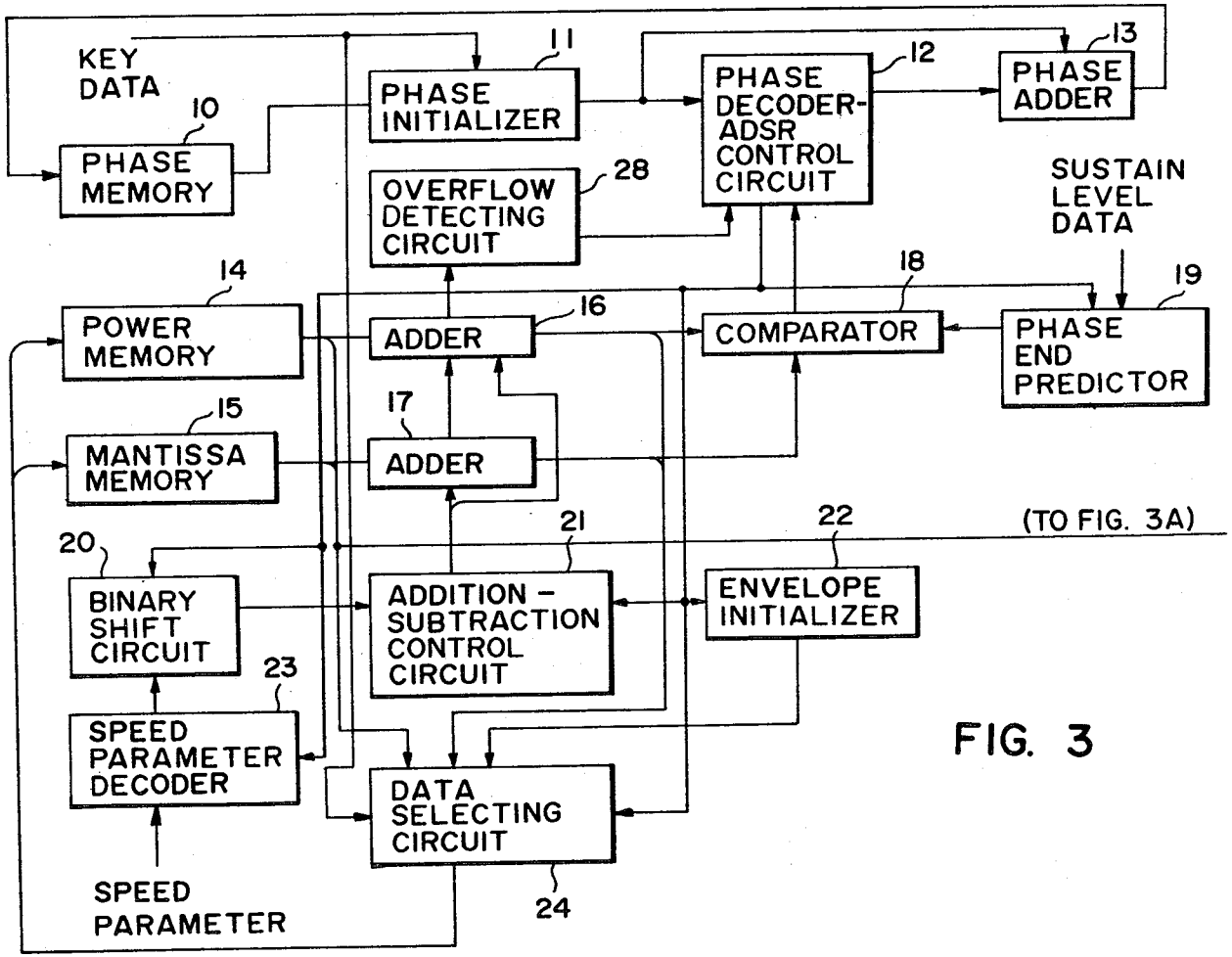
FIGS. 3 and 3A are block diagrams illustrating the arrangement of an envelope generating circuit according to a second embodiment of the present invention.
Figure 3A:
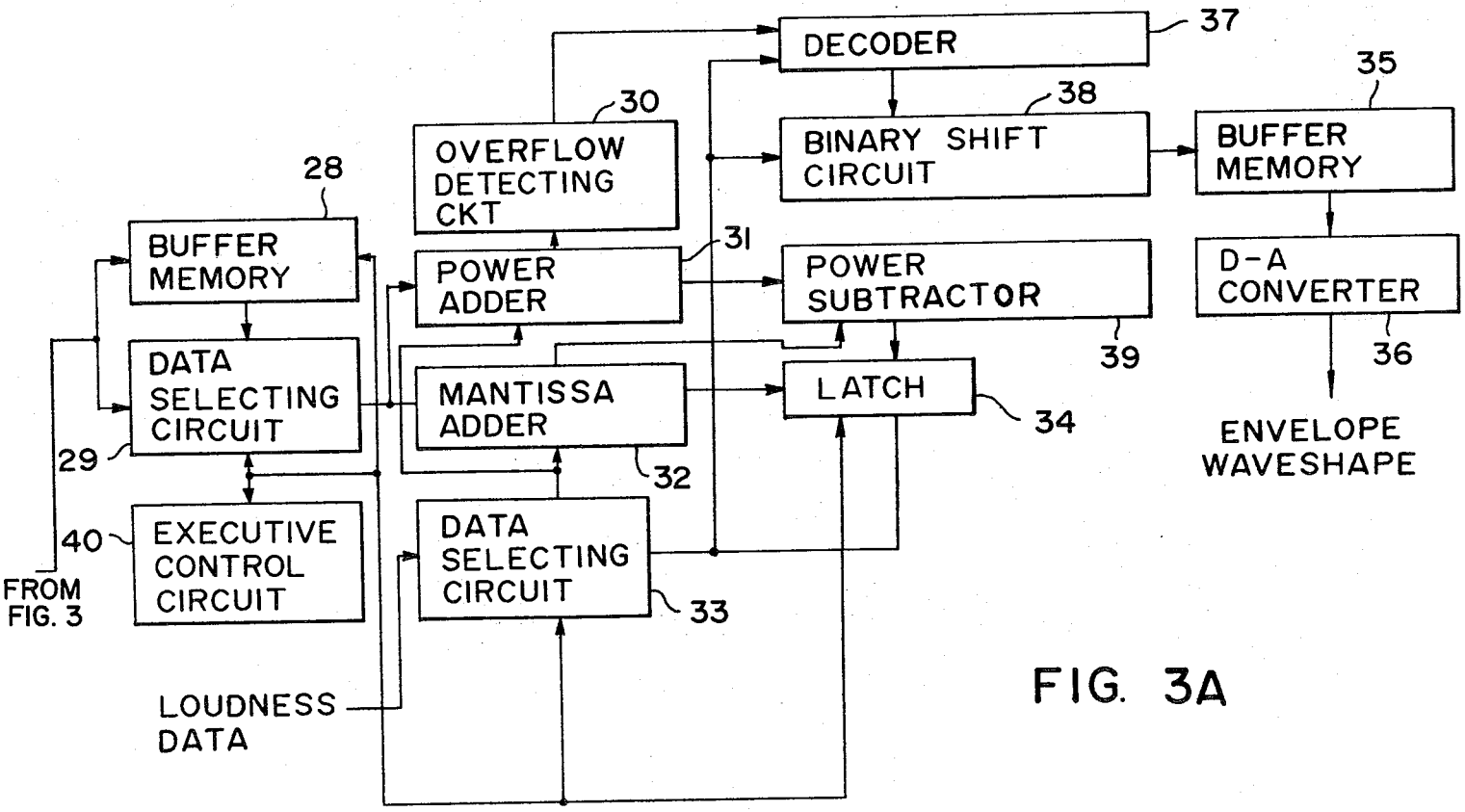

FIGS. 3 and 3A show, in block form, an envelope generating circuit according to a second embodiment of the present invention. A detailed description will be given, with reference to FIG. 3, of the second embodiment. In this embodiment, a predetermined ordinary envelope is formed in the same manner as in the first embodiment and, further, an envelope for the amplitude modulation effect is also formed by the same envelope generator. The envelope for the amplitude modulation effect thus obtained is once stored in a buffer memory 28. For example, an repeat effect as of a marimba can easily be produced by providing a predetermined repeat signal as a start signal on a line of key data and setting ADSR parameters of a waveshape of a percussive sound.

The crescendo effect can similarly be obtained by inputting, as a start signal, a signal of the logical sum of signals of all keys being depressed and setting an ADSR parameter of slow rise.

Next, the calculated ordinary envelope is read out from the power memory 14 and the mantissa memory 15 and applied to a data selecting circuit 29 and, at the same time, the envelope for the amplitude modulation effect is read out from the buffer memory 28 and fed to the data selecting circuit 29 under the control of an executive control circuit 40.

In the data selecting circuit 29 and circuits combined therewith, the ordinary envelope and the envelope for the amplitude modulation effect are multiplied. Now, a description will be given of a multiplying method which is characteristic of an ADSR generator employing the floating-point arithmetic in the present invention.

$$A=(1+a_1\times 2^{-1}+a_2\times 2^{-2}+a_3\times 2^{-3})\times 2^{-c} \quad (1)$$

$$B=(1+b_1\times 2^{-1}+b_2\times 2^{-2}+b_3\times 2^{-3})\times 2^{-d} \quad (2)$$

Represented in the form of floating-point numbers using binary numbers, two numbers A and B can be given by the above expressions (1) and (2). They are numbers corresponding to those shown in Table 1. The multiplication of the numbers A and B can be expressed as follows:

$$\begin{aligned} A\times B=\{&1+(a_1+b_1)\times 2^{-1}+(a_2+b_2)\times 2^{-2}\\ &+(a_3+b_3)\times 2^{-3}\\ &+a_1b_1\times 2^{-2}+(a_1b_2+a_2b_1)\times 2^{-3}+(a_1b_3+a_2b_2\\ &+a_3b_1)\times 2^{-4}\\ &+(a_2b_3+a_3b_2)\times 2^{-5}+a_3b_3\times 2^{-6}\}\times 2^{-(c+d)} \end{aligned} \quad (3)$$

Discarding the term $a_1b_1\times 2^{31\,2}$ et seq. from the expression (3), the following approximate expression (4) is obtained.

$$A\times B=\{1+(a_1+b_1)\times 2^{-1}+(a_2+b_2)\times 2^{-2}+(a_3+b_3)\times 2^{-3}\}\times 2^{-(c+d)} \quad (4)$$

As will be seen from the above approximate expression, the multiplication of the numbers A and B can be expressed by an addition of fraction parts of their mantissa parts and an addition of their exponent parts. A round-off error in this case is about ±2 dB at maximum according to measured values and it is supposed that this approximate multiplication would be applicable to an envelope waveshape which is represented by a monotone increasing or decreasing function; in hearing tests, satisfactory results were obtained.

A first step of the multiplication is to multiply ordinary ADSR data by loudness data for providing volume level which differs with tones to be produced or their sound ranges. At first, the ordinary ADSR data is selected by the data selecting circuit 29 under the control of the executive control circuit 40 and its exponent part and mantissa part are provided to an power adder 31 and a mantissa adder 32, respectively. On the other hand, a data selecting circuit 33 selects loundness data under the control of the executive control circuit 40 and sends its exponent part and mantissa part to the other inputs of the power adder 31 and the mantissa adder 32, respectively. The power adder 31 adds the exponent parts of the ordinary ADSR data and the loudness data and applies the added output to an power subtractor 39. Similarly, the mantissa adder 32 adds the mantissa parts of the both data and supplies the added output to a latch 34. If a carry occurs as a result of the addition of the mantissa parts, a signal is applied to the power subtractor 39 so that a numerical value 1 may be subtracted from the calculation result of the exponent parts. When supplied with such a carry signal, the power subtractor 39 subtracts the numerical value 1 from the exponent and, in the absence of the signal, it delivers the data as it is to the latch 34. The latch 34 latches therein these calculation results, thus completing the first step.

The next second step consists in multiplying the above calculation results by the envelope for the amplitude modulation effect. As in the first step, the data selecting circuit 29 selects data of the buffer memory 28 and applies it to the power adder 31 and the mantissa adder 32. The data selecting circuit 33 selects the data of the latch 34 and applies it to the power adder 31 and the mantissa adder 32. The power adder 31, the mantissa adder 32 and the power subtractor 39 operate in the same manner as in the first step and the resulting data is latched in the latch 34 and its exponent and mantissa parts are provided to a decoder 37 and a binary shift circuit 38, respectively. The decoder 37 decodes data of the exponent part and controls the binary shift circuit 38. In the event that a carry occurs during the calculation of the exponent parts in the first and second steps, a carry signal is applied from the power adder 31 to an overflow detecting circuit 30.

The overflow detecting circuit 30 holds and applies the signal to the decoder 37. This signal means a numerical value outside of a dynamic range which can be expressed when the exponent part is, for example, $-7-7=-14$. Accordingly, when supplied with this signal, the decoder 37 operates to round the calculated value down to a minimum level. The binary shift circuit 38 shifts the mantissa part data based on the signal from the decoder 37 to render the data from the floating-point number to a fixed-point number, which is provided to a buffer memory 35. The buffer memory 35 temporarily stores the data under the control of the executive control circuit 40. The buffer memory 35 is repeatedly read out by the executive control circuit 40 at a rate different from the calculation rate of ADSR generator. A D-A converter 36 converts the read-out data into an analog voltage to form an envelope waveshape.

Figure 4:
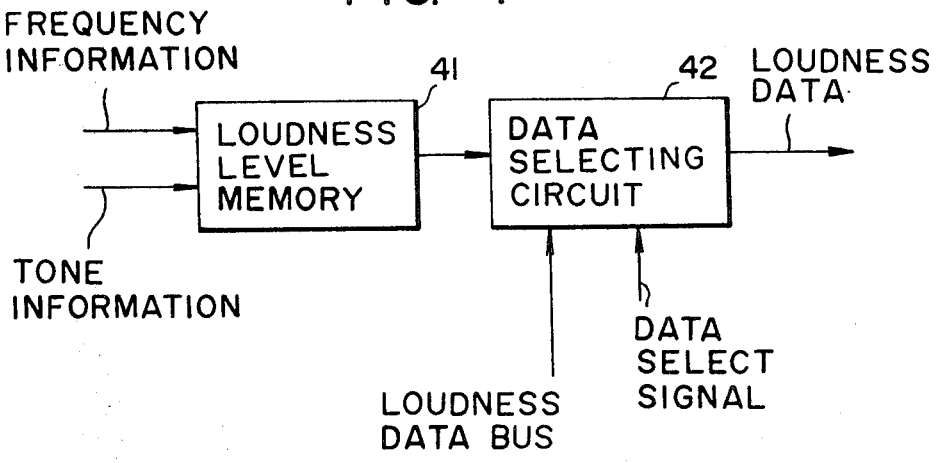
FIG. 4 is a block diagram showing a specific example of a loudness data input part in the envelope generating circuit of the second embodiment of the present invention.

FIG. 4 illustrates a specific example of the circuit arrangement of the loundness data input part in FIG. 3. The loudness data is provided from a loudness level memory 41 and a loudness data bus which is controlled from the outside. The loudness level memory 41 is read out by frequency information of a keyboard to be manipulated and information of a tone to be produced and the data thus read out is applied to a data selecting circuit 42. The data selecting circuit 42 selects either one of this data and the data from the loudness data bus by a data select signal. The loudness data thus selected is used as described previously. The data from the loudness level memory 41 is controlled in loudness level according to the frequency of a sound to be produced or the keyboard. The data from the loudness data bus is data for adjusting the balance between the tones to be produced. The loudness level memory 41 may be small in capacity and the system can be made economical if patterns fewer than the tones to be produced are prestored in the memory and if the data from the loudness data bus for adjusting the balance between the tones is multiplied by the aforesaid floating-point.

Next, the present invention will be described as being applied to an electronic musical instrument.

Figure 5:
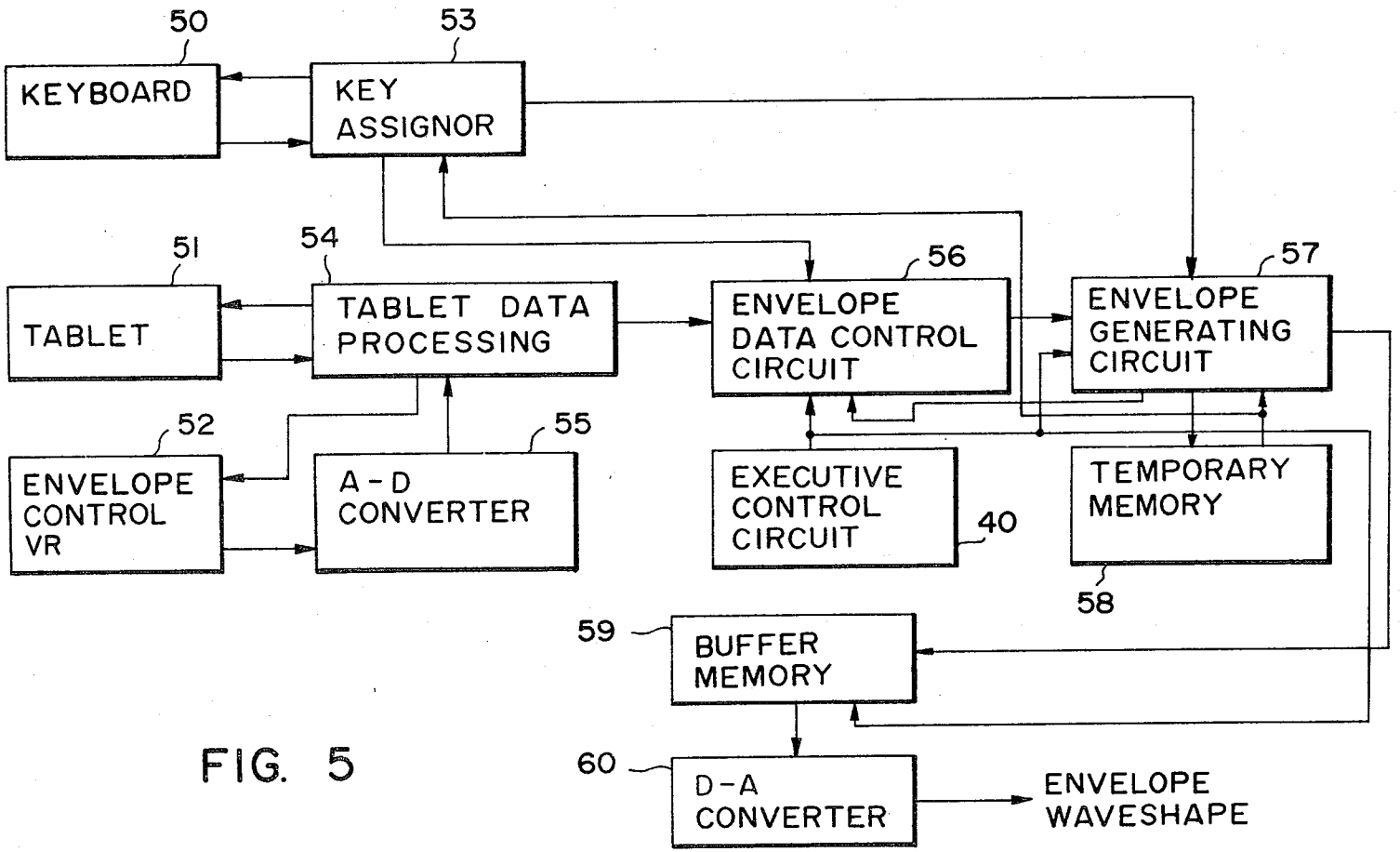
FIG. 5 is a block diagram explanatory of the outline of an example of an electronic musical instrument embodying the present invention.

FIG. 5 is a block diagram showing an example of the electronic musical instrument embodying the present invention. In FIG. 5, key information from a keyboard 50 which is manipulated by a player is processed by a key assignor 53 and its output is applied to an envelope generating circuit 57. Data from a tablet 51 and envelope control VR (variable resistor) 52 which are set by the player are processed by a tablet data processing circuit 54, the output from which is applied to an envelope data control circuit 56 which forms the principal part of the present invention. The value of the envelope control VR 52 is once subjected to an A-D conversion by an A-D converter 55 and then sent out. The envelope data control circuit 56 processes the data supplied thereto and delivers to the envelope generating circuit 57 a speed parameter for determining the envelope waveshape. Based on the speed parameter and the key information from the key assignor 53, the envelope generating circuit 57 calculates the envelope and transfers the data to a buffer memory 59. Further, the envelope generating circuit 57 temporarily stores in a temporary memory 58 a final calculated value of the envelope as data for time divided calculations in preparation for the next computation. The buffer memory 59 is repeatedly read out by the executive control circuit 40 at a rate different from the envelope calculation rate and the data read out is supplied to a D-A converter 60. The D-A converter 60 converts the digital value of the envelope into an analog voltage to form an envelope waveform.

Figure 6:
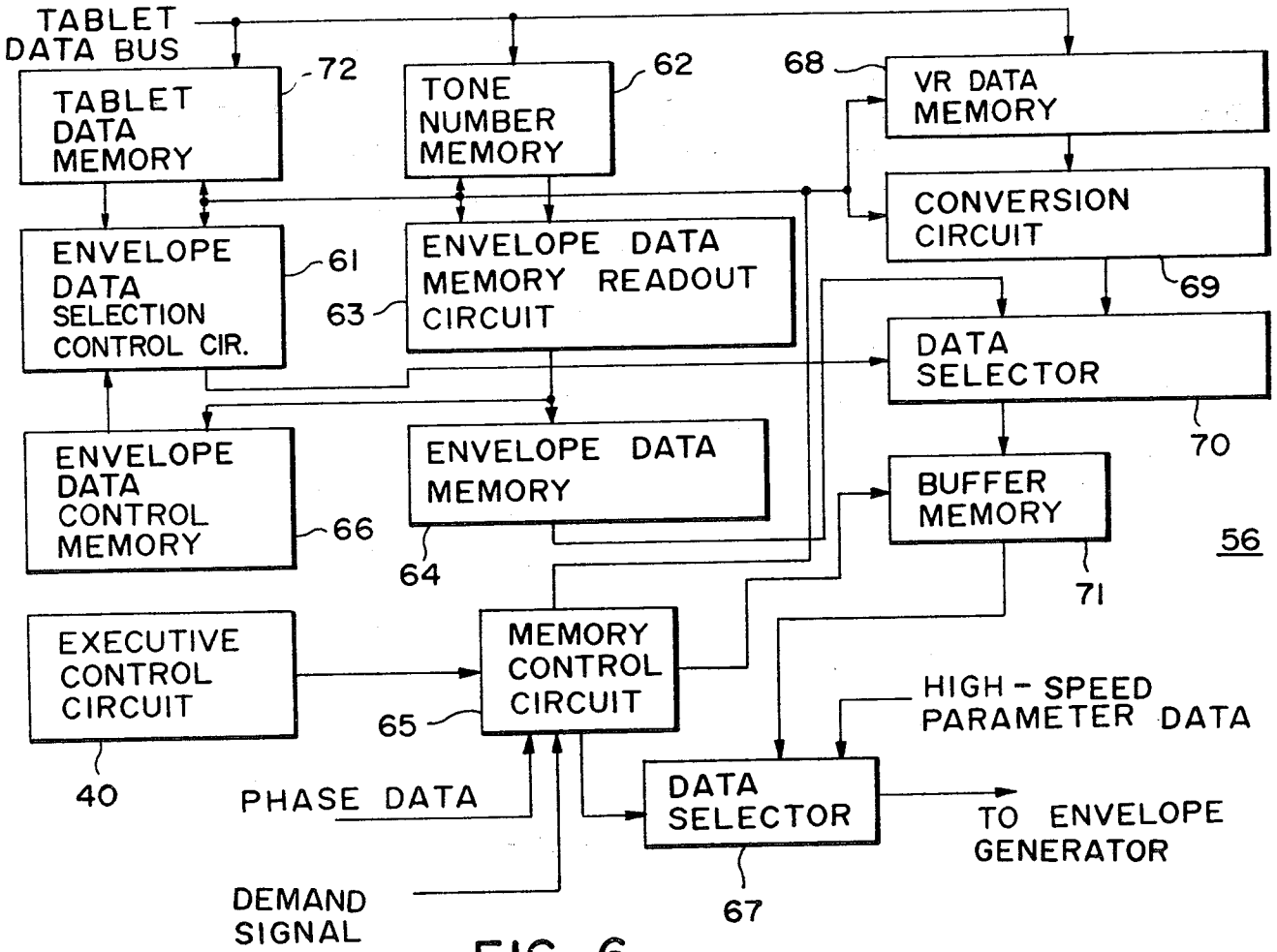
FIG. 6 is a block diagram showing the arrangement of the principal part of the electronic musical instrument depicted in FIG. 5.

FIG. 6 is explanatory of the arrangement of the principal part of the example shown in FIG. 5, illustrating a detailed block diagram of the envelope data control circuit 56.

The data processed by the tablet data processing circuit 54 is sent to the envelope data control circuit 56 via a tablet data bus in FIG. 6. The data which is transmitted via this data bus are such, for instance, as data of a switch for a sustain effect (which is different from a sustain level showing the steady state of an envelope) for increasing the attenuation time of a sound, data of switches such as a knee lever switch which is controlled by a knee of the player for producing an effect similar to muting effect as of a damper pedal of a piano, a marimba switch and a crescendo switch for adding amplitude modulation effects by tones, a synthesizer switch for synthesizing a sound and like switches, digitized data of a sustain time VR for adjusting the length of the attenuation time of the abovesaid sustain effect, a crescendo time VR for adjusting the rise time of a sound and VR's for adjusting the attack, decay, sustain and release of a sound in a synthesizer, and data of a digital number added to a tablet switch of a tone to be produced (which number is referred to as a tone number). The data of these switches are stored in a tablet data memory 72.

Figures 7A, 7B, 7C:
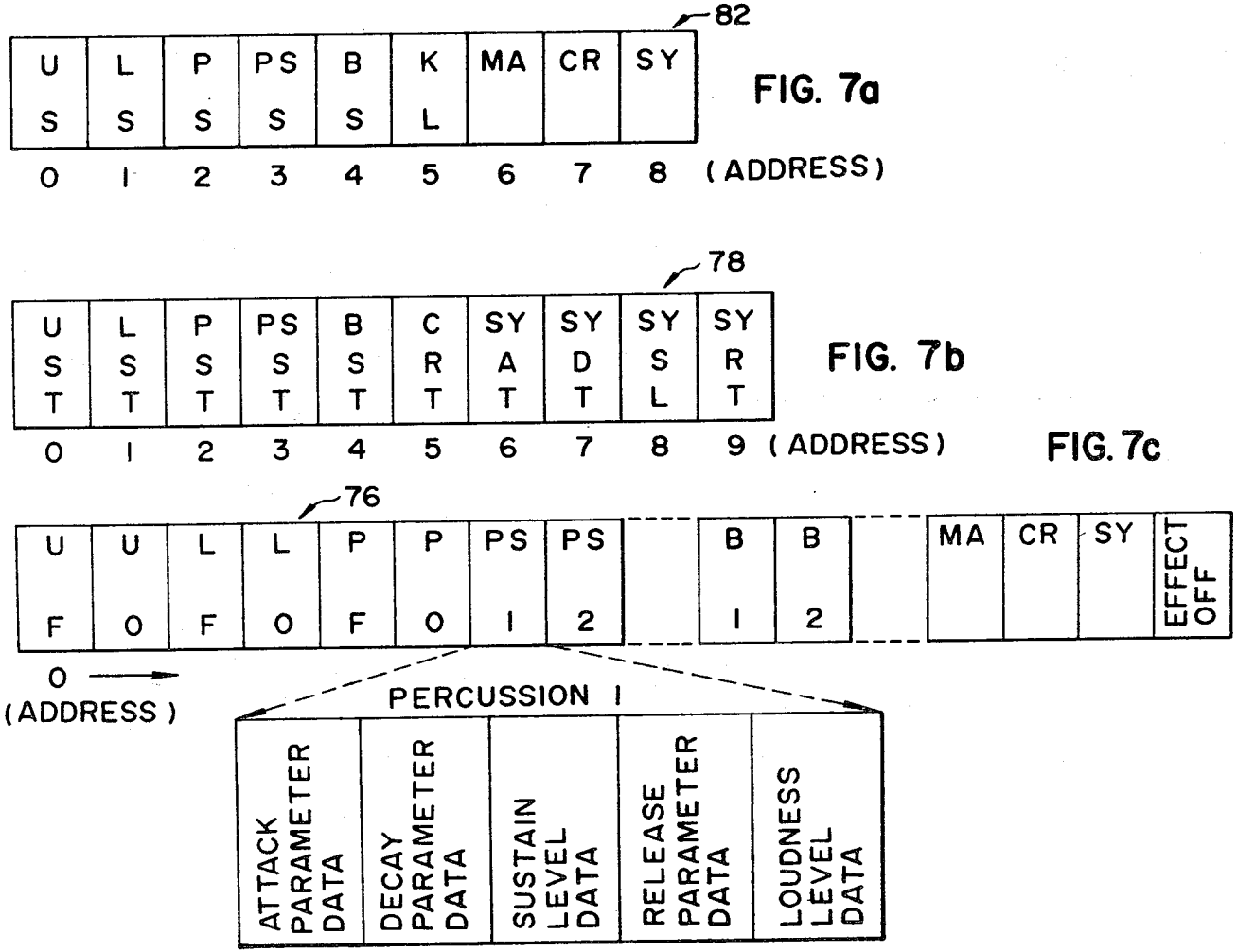
FIG. 7 shows specific examples of the contents of memories used in the principal part of the electronic musical instrument illustrated in FIG. 6.
Figures 7D, 7E:
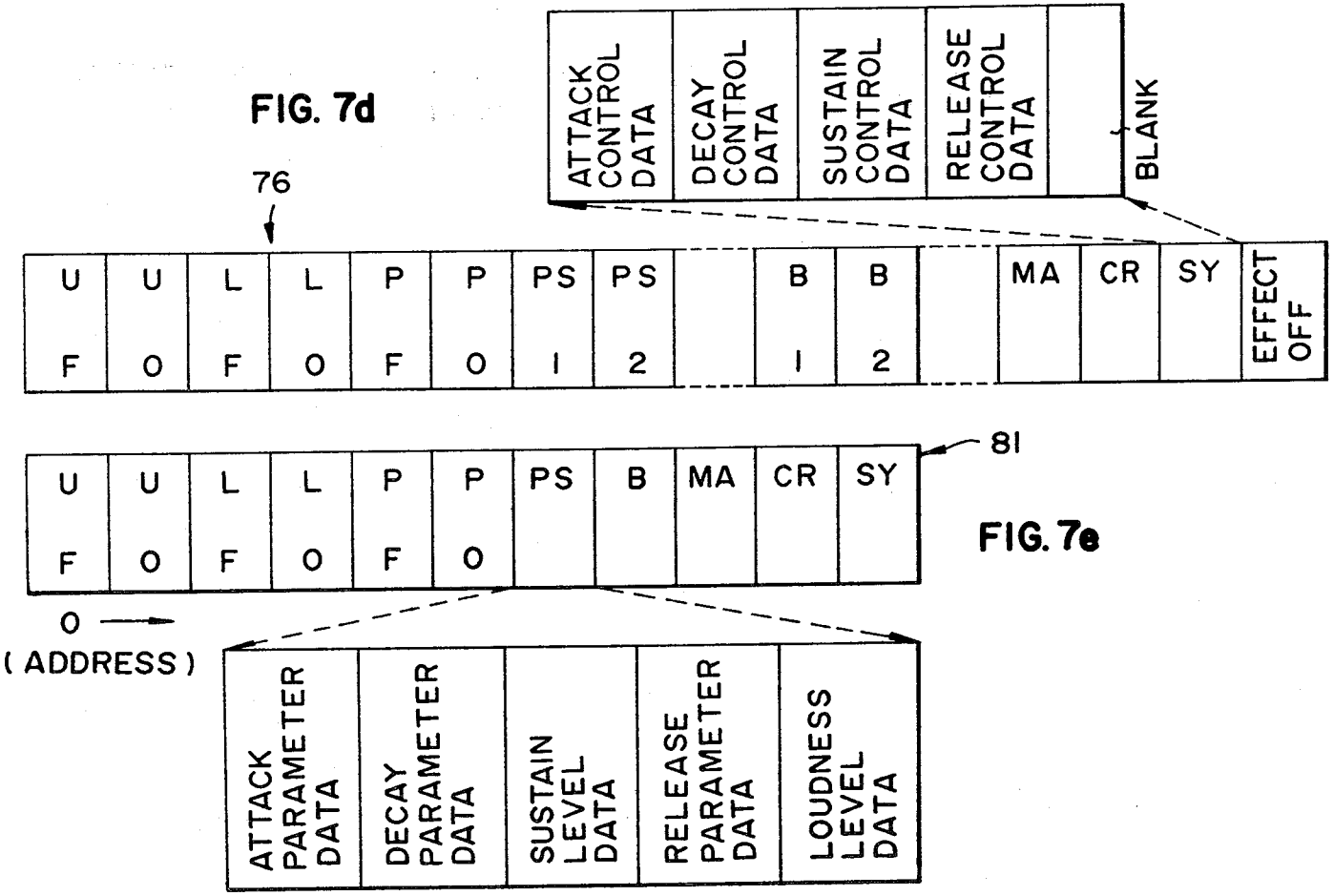

In FIG. 7(*a*), reference numeral 82 indicates the content of the tablet data memory 72 in FIG. 6. The tablet data memory 72 is formed, for instance, by an RAM and the state of each switch is stored at each respective address of the RAM. For instance, an upper keyboard sustain tablet switch US in the content 82 of the tablet data memory 72 is stored as "1" or "0" depending on whether it is in the ON or OFF state.

In FIG. 7(*a*), reference character LS is a lower keyboard sustain tablet; PS is a pedal keyboard sustain tablet switch; PSS is a percussion sound (a percussive sound as by a piano) sustain tablet; BS is a sustan tablet for a sound of a brass or wood instrument; KL is a knee lever; MA is a tablet for an amplitude modulation effect which repeatedly produces percussive sound as by a marimba; CR is a tablet for the crescendo effect; and SY is a synthesizer tablet. As mentioned above, the state of each tablet switch is stored by a memory control circuit 65.

Next, the aforesaid VR data are stored in a VR data memory 68, the contents of which are shown by 78 in FIG. 7(*b*). In FIG 7(*b*), UST is an upper keyboard sustain time, LST is a lower keyboard sutain time and the subsequent reference characters are similar to them. SYAT, SYDT, SYSL and SYRT are an attack time, a decay time, a sustain level (a steady level of a sound) and a release time of the synthesizer.

Tone number data are written by the memory control circuit 65 in a tone number memory 62. The tone numbers are given to each of a plurality of tones. The tone numbers are arranged so that a selected tone may be produced. In this case, there are two kinds of series such as a percussion series PS and a brass series B.

The contents of a buffer memory 71 are shown by 81 in FIG. 7(*e*). In FIG. 7(*e*), UF is an upper keyboard flute series; UO is an upper keyboard orchestra series (tone series of strings etc.); LF is a lower keyboard flute series; LO is a lower keyboard orchestra series; PF is a pedal keyboard flute series; PO is a pedal keyboard orchestra series; PS is a percussion series; B is a brass series (brass and wood wind instruments); MA is a marimba effect; CR is a crescendo effect; and SY is a synthesizer. The buffer memory 71 has areas for storing attack, decay, sustain, release and loudness data of them. The buffer memory 71 is formed by an RAM.

Assuming that the contents 81 of the buffer memory 71 are processed in a sequential order starting with the address 0 in FIG. 7(*e*), the memory control circuit 65 assigns the address 0 of the buffer memory 71 in accordance with a control signal from the executive control circuit 40. The address 0 is a memory area for attack parameter data of UF.

Next, the memory control circuit 65 sends a signal to an envelope data memory readout circuit 63, which provides address signals to an envelope data memory 64 and an envelope data control memory 66.

The contents of the envelope data memory 64 are indicated by 74 in FIG. 7(*c*) and the contents of the envelope data control memory 66 are indicated by 76 in FIG. 7(*d*). From the envelope data memory 64 is read out by the abovesaid address signal the attack parameter data of UF, which is applied to a data selector 70. At the same time, a signal for controlling envelope data is read out from the envelope data control memory 66 and provided to an envelope data selection control circuit 61. This signal is represented by one bit and is a signal for selecting the data stored in the envelope data memory 64 or the VR data stored in the volume data memory 68. The envelope data selection control circuit 61 operates to select the content of the envelope data memory 64 or the VR data memory 68 depending on whether the envelope data control signal is "0" or "1".

The envelope data selection control circuit 61 receives the abovesaid signal as one input and data from the tablet data memory 72 as another input. The content of the tablet data memory 72 is read out by a signal from the memory control circuit 65. The envelope data selection control circuit 61 obtains, for example, the logical product of the two inputs and applies it to the data selector 70. For example, in the case where US in the contents 82 of the tablet data memory 72 is "1" and attack control data of UF in the contents 76 of the envelope data control memory 66 is "0", the envelope data selection control clrcuit 61 yields an output signal "0", causing the data selector 70 to select the output from the envelope data memory 64. Thus, the data selector 70 applies the attack parameter data to the buffer memory 71, wherein it is written by a write signal from the memory control circuit 65 at an address for the attack parameter data of UF of the contents 81. In a likewise manner, respective data of the decay parameter, the sustain level and the loudness level are written in the buffer memory 71.

On the other hand, if the signal read out from the envelope data control memory 66 is "1" in the processing of the release parameter, the logical product of the signal and the signal from the tablet data memory 72 in the envelope data selection control circuit 61 is "1" and the data selector 70 selects data from a conversion circuit 69. From the VR data memory 68 is read out by the memory control circuit 65 the data of UST in the contents 78 and the data is provided to the conversion circuit 69. The conversion circuit 69 has a plurality of converters of different characteristics, one of which is selected by the memory control circuit 65. The data from the VR data memory 68 is converted by the conversion circuit 69 and sent to the data selector 70, thereafter being written in the buffer memory 71. As a result of this, the release time of UF is controlled by a VR. Thereafter, data of UO and so forth are written in the buffer memory 71.

In connection with the percussion and the brass series, the tone number of the content of the tone number memory 62 is read out by the memory control circuit 65 and fed to the envelope data memory readout circuit 63. In accordance with the tone number the envelope data memory readout circuit 63 determines which one of the data of PS and B in the contents 76 of the envelope data memory 64 is to be read out. The subsequent data processing takes place in the same manner as described above.

If KL in the contents 82 of the tablet data memory 72 is "1", then a signal is applied to the envelope data selection control circuit 61 as if all the tablet switches are in the ON state regardless of the state of, for example, US, PS and BS. In this way, the attenuation time can be controlled not only by the tablet but also by the knee lever.

If MA is "1", the same processing as that for UF is performed and, if it is "0", data of EFFECT OFF in the contents 76 of the envelope data memory 64 is written in the buffer memory 71. By this, it is controlled whether to add the marimba effect. This also applies to the case of CR. When SY is "1", data of SYAT, SYDT, SYSL and SYRT in the contents 78 of the VR data memory 68 are written in the buffer memory 71 via the conversion circuit 69.

Next, phase data is provided from the envelope generating circuit 57 to the memory control circuit 65. By this phase data and a signal from the executive control circuit 40 the address assignment of the buffer memory 71 is performed as follows: For example, in the attack phase, the attack parameter data is read out from the buffer memory 71 and, in the decay phase, the decay paramter data is read out. The data thus read out from the buffer memory 71 is applied via a data selector 67 to the envelope generating circuit 57 in FIG. 5 on a time divided basis.

Next, in the case where keys are depressed in excess of the number of channels possible of tone production, the key assignor 53 detects it, reads out phase data of each channel from the temporary memory 58 connected to the envelope generating circuit 57, detects the channel of the phase having advanced more than the other channels and sends a demand signal to the memory control circuit 65 of the envelope data control circuit 56 in synchronism with the timing for computation of the envelope of the channel. The memory control circuit 65 applies a signal to the data selector 67 to select high-speed parameter data. By supplying the envelope generating circuit 57 with such parameter data that terminates the attenuation of a sound at high speed, the channel of the most advanced phase be cleared off.

Next, a description will be given of the loudness control. Assuming that the loudness level data of the envelope data memory 64 is represented by eight bits, for example, and that the most significant bit is a control bit with the low-order seven bits data bits, the control bit serves as the data select signal in FIG. 4 and the low-order seven bits serve as loudness level data. When the control bit is "1", the data selecting circuit 42 selects the loudness level data on the loudness data bus and when the control bit is "0", the data selecting circuit 42 selects the output from the loudness level memory 41. The loudness level memory 41 is read out by the frequency information from the key assignor 53 in FIG. 5 (which information may be replaced with information of a key being depressed) and tone information. In this case, for instance, by storing the tone information in the above-said low-order seven bits when the control bit is "0", the line for the tone information can be formed by the same line as that for the loudness data bus.

In this example, the respective data read out from the buffer memory 71 are provided via the data selector 67 to the envelope generating circuit 57 in FIG. 5, wherein they are distributed to the inputs of ADSR parameter data, sustain level parameter and loudness level data. In this case, a latch circuit is required for latching the data sent on the time divided basis but no description will be given of such a latch circuit.

Figure 8:
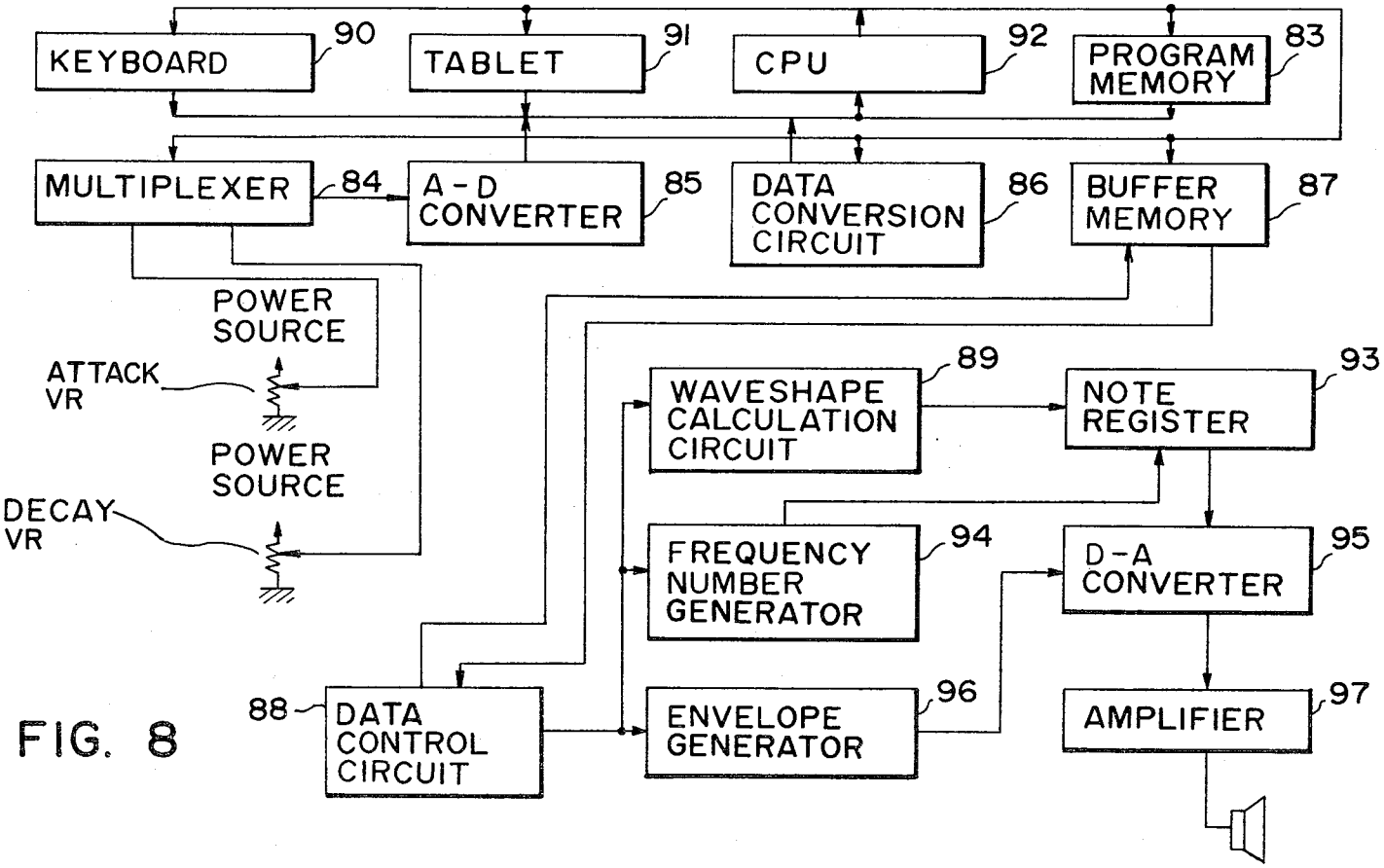
FIG. 8 is a block diagram illustrating the arrangement of a third embodiment of the present invention.

Next, a description will be given, with reference to FIG. 8, of a third embodiment of the envelope generator of the present invention which controls the envelope. In FIG. 8, a CPU 92 detects the state of a keyboard 90 or a tablet 91 according to a program of a program memory 83 and transfers the information to a buffer memory 87. The data stored in the buffer memory 87 is read out therefrom by a data control circuit 88 and transferred to a waveshape calculation circuit 89, a frequency number generator 94 and an envelope generator 96 in a predetermined order and at a predetermined rate. The waveshape calculation circuit starts its waveshape calculation and, upon completion of the calculation, transfers waveshape data to a note register 93. The waveshape data stored in the note register 93 is read out therefrom at a rate of the frequency of a musical note to be produced which is determined by the frequency number generator 94 and the waveshape data thus read out from the note register 93 is provided to a D-A converter 95 for conversion into an analog waveshape signal. The envelope generator 96 computes an envelope under the control of the data control circuit 88 and the computed envelope is transferred to the D-A converter 95, wherein it is converted into analog form and then multiplied by the waveshape signal. The multiplied output from the D-A converter 95 is applied via an amplifier 97 to a sound system.

The principal part of the present invention is an arrangement including a multiplexer 84, an A-D converter 85 and a data conversion circuit 86. Under the control of the CPU 92 the multiplexer 84 is operated, from which a voltage corresponding to a resistance value set by a required VR; for instance, an attack VR, decay VR or the like is applied to the A-D converter 85 for conversion into digital data. The digital data is once stored in a register of the CPU 92 and then read out therefrom and transferred to the data conversion circuit 86, wherein it is converted into speed parameters of attack, decay or the like.

Figure 9:
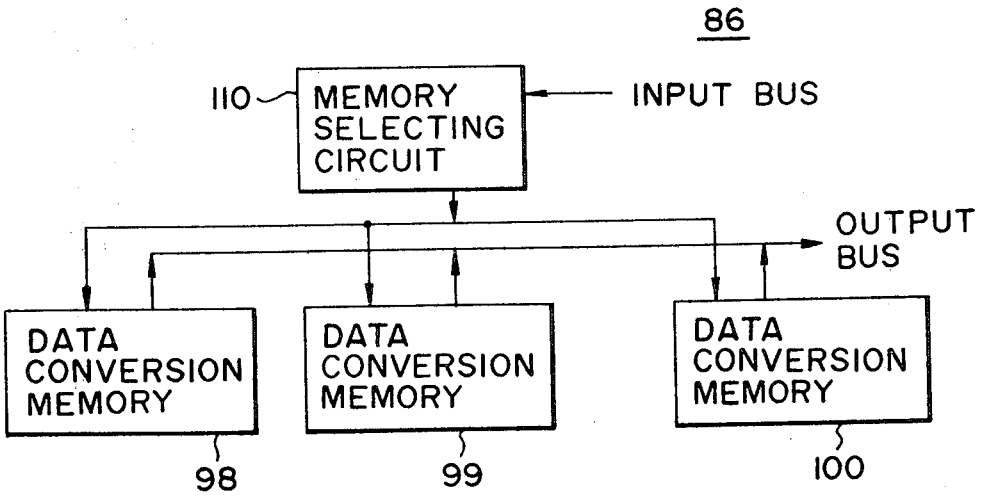
FIG. 9 is a block diagram showing a specific example of a data converting circuit utilized in the third embodiment illustrated in FIG. 8.

FIG. 9 shows a specific example of the circuit arrangement of the data conversion circuit 86 utilized in the embodiment of FIG. 8. The data conversion memories 98 to 100 have stored therein data A', B' and C' shown in FIG. 11 which respectively correspond to the characteristics of the VR's of an attack time characteristic A, a decay time characteristic B and a tone control (sliding Formant) envelope attack time characteristic C shown in FIG. 10, that is parameters for controlling the speeds of the attack, decay, etc. of an envelope corresponding to A-D converted digital data. A memory selected circuit 110 is supplied with a command from the CPU 92 via an input bus. In accordance with the command, A-D converted digital data are read out as a speed parameter from the data conversion memory 98 to 100 and provided on an output bus. The speed parameter thus delivered out are stored in the buffer memory 87 via the CPU 92. In this manner, data are transferred to the envelope generator 96 by the abovesaid method, wherein the attack, decay and so forth of the envelope are formed. Thus, an envelope of desired change characteristic can be controlled only by setting the attack VR, decay VR and other VR's to predetermined resistance values as described.

Figure 10:
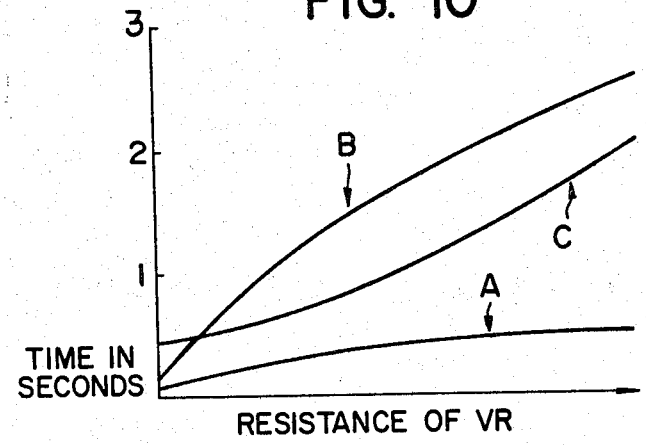
FIG. 10 is a graph showing an attack time characteristic, a decay time characteristic and an envelope attack time characteristic in the third embodiment depicted in FIG. 8.
Figure 11:
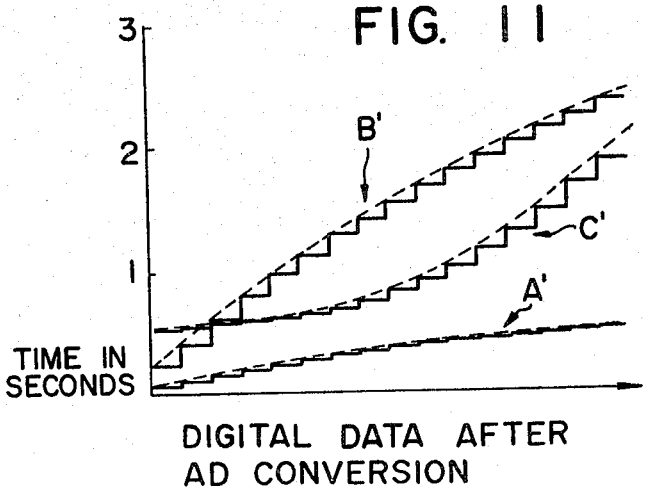
FIG. 11 is a graph showing the contents of data conversion memories corresponding to the characteristics of FIG. 10.

In this case, in order to perform such envelope control, for example, by a single attack VR, that an attack of an ordinary envelope and an attack of an envelope (for sliding Formant) changing the tone with time are simultaneously produced and different change characteristics are provided, the content C' of the tone control sliding Formant attack data conversion memory shown in FIG. 11, which corresponds to the tone control envelope attack time characteristic C such as shown in FIG. 10, is stored, for example, in the data conversion memory 100 and the content is processed by the method described above. In this way, an ordinary envelope and a sliding Formant envelope can be simultaneously controlled by different characteristics using only one VR.

As has been described in the foregoing, according to the first embodiment of the present invention, the attack, decay and release of an envelope are set by speed parameters in digital forms and decoded and applied to desired calculating means. This method eliminates the necessity of many oscillators and accumulators for setting the speeds of the attack, decay and release, and hence permits a substantial reduction of the number of input terminals used; therefore, the system of the present invention is suitable for fabrication as an integrated circuit. Further, according to the system of forming an envelope by setting such speed parameters and calculating them after decoding, it is possible to easily generate various envelopes, for example, envelopes of different waveshapes, an envelope for the sliding Formant filter, an envelope for amplitude modulation and so forth. And, by prestoring these parameters in external storages and suitably reading out therefrom and setting them, many kinds of envelopes can be obtained, so that the memory area required may be very small and, even in the case of performing many kinds of envelope control, it is sufficient to provide a small storage in the system.

The speed parameters used in this invention are fit for use with time-division calculating means, in particular, an arithmetic unit employing the floating-point number. It is also an advantage of the present invention that the speed parameters can easily be combined with various functions and effects, such as a multiplication by an amplitude modulated wave, volume level control according to the position on a keyboard, control of the amplitude of the envelope for the sliding Formant filter and so forth.

Further, according to the second embodiment of the present invention described in the foregoing, in an electronic musical instrument provided with calculating means for calculating the envelope waveshape at predetermined timing based on speed parameters representing the envelope waveshape, envelope data for the amplitude modulation effect, calculated by the calculating means, is stored in a temporary buffer memory and predetermined envelope data corresponding to a key depression, calculated by the calculating means, the envelope data for the amplitude modulation effect and volume level data such as loudness data are multiplied on a time divided basis. The envelope data which are calculated by the calculating means are each represented by an exponent part and a mantissa part of the floating-point; the calculating means is composed of calculators corresponding to the exponent and mantissa parts; the multiplications of the abovesaid three data are conducted by simple additions; and they can be calculated by one system of multiplying means on the time divided basis through data selection. Therefore, desired amplitude modulation effects can freely be added and the volume level of each tone can arbitrarily be adjusted. Thus, a variety of envelope waveshapes can easily be obtained at low cost without the necessity of many multiplying circuits.

In addition, according to the present invention described in detail as being applied to an electronic musical instrument, an envelope waveshape is represented by a speed parameter; the speed parameter is stored in memory means and read out therefrom on the time divided basis and the waveshape of rise or fall of the envelope is calculated on the time divided basis. This does not require complex circuit arrangement involving many CR circuits and CR oscillators for determining the envelope waveshape, accumulators and clock generators, permitting a markedly simple and inexpensive system arrangement. Moreover, since the envelope waveshape is calculated on the time divided basis, many envelopes can be produced and an envelope for the sliding Formant filter can also be generated by one envelope generator. The envelope data are all subjected to digital control; this is suitable for fabrication as an integrated circuit, that is, miniaturization.

Furthermore, according to the third embodiment of the present invention, a plurality of data having different change characteristics corresponding to one data of a control VR are selected according to the timing of an envelope waveshape and a data conversion circuit is provided for controlling the waveshape, tone and so forth of the envelope. This permits easy control of the waveshape, tone and volume level of the envelope with a relatively simple arrangement.

It will be apparent that many modifications and variations may be effected without departing from the scope of the novel concepts of this invention.

What is claimed is:

1. An envelope generator for electronic musical instruments which generates an envelope of a musical note by a calculation of predetermined timing, comprising:

tablet switch means for selecting a tone type, variable resistor means for setting attack and decay rate data;

control information generating means for generating control information responsive to either or both of said tablet switch means and said variable resistor means;

first memory means for storing speed parameters of the envelope which are determined corresponding to the speeds of attack, decay and release of the envelope to be generated in response to a key depression;

second memory means for storing a signal for determining which to control of a rise and a fall time of a sound to be produced;

first readout means responsive to said signal from said second memory means and said control information generating means, for reading out a speed parameter from said first memory means; and calculating means for calculating an envelope waveshape based on the speed parameter readout by said first readout means.

2. An envelope generator according to claim 1 wherein said calculating means comprises envelope waveshape calculating means for calculating the envelope waveshape by the speed parameter read out by said first readout means; multiplying means for one of adding an amplitude modulation effect to the output of said envelope waveshape calculating means and controlling a level of the output of said envelope waveshape calculating means; and converting means for converting a calculation result of said multiplying means into said musical waveshape data.

3. An envelope generator according to claim 2, further comprising third memory means for temporarily storing envelope data for an amplitude modulation effect to be added to a predetermined waveshape, said envelope data being calculated by said calculating means, wherein said multiplying means multiplies, on a time divided basis, predetermined envelope data calculated by said calculating means in response to the key depression, envelope data for an amplitude modulation effect selectively read out from said third memory means and volume level data which has been set for each tone, and wherein said converting means converts the calculation result of said multiplying means into musical waveshape data.

4. An envelope generator according to claim 3, wherein a volume level of the musical note and a parameter of a tone control envelope are controlled in accordance with an information of the frequency of a musical note to be generated and an information of the keyboard.

5. An envelope generator according to claim 2, wherein the envelope data calculated by said envelope waveshape calculating means is represented by an exponent part and a mantissa part of a floating point number and said multiplying means is composed of calculators for the exponent part and the mantissa part, respectively.

6. An envelope generator according to claim 2, wherein said converting means is a circuit wherein a floating point number representing the envelope data is converted into a fixed point number.

7. An envelope generator according to claim 2, wherein said envelope waveshape calculating means comprises phase memory means for storing phase data for dividing the envelope into a plurality of individual phases; envelope data memory means for temporarily storing amplitude data of the envelope represented by an exponent and a mantissa; phase initializing means for initializing the phase of the envelope in response to one of a key depression and a key release; speed parameter decoding means for decoding the speed parameters representing the envelope speed; displacement generating means for generating displacement corresponding to a signal from said speed parameter decoding means and the phase of the envelope; adding-subtracting means for one of adding together and subtracting one from the other data from said envelope data memory means and data from said displacement generating means according to the phase of the envelope; phase end predicting means for providing an end value of each phase, comparing means for comparing the output from said adding-subtracting means with the output from said phase end predicting means; phase adding means for shifting the phase when the output from said comparing means is at least equal to said phase end value; envelope initializing means for initializing the envelope; and data selecting means for selectively storing the output from one of said envelope initializing means, said envelope data memory means and said adding-subtracting means.

8. An envelope generator according to claim 7, further comprising first overflow detecting means for detecting the overflow of the calculating result in said adding-subtracting means, storing the amplitude data before the calculation in said envelope data memory means and advancing the phase of the envelope.

9. An envelope generator according to claim 8, further comprising second overflow detecting means for detecting the overflow of said multiplying means and rounding the calculated data by said multiplying means.

10. An envelope generator according to claim 1, further comprising generating means for generating digital data for controlling the envelope waveshape, tone and volume level of a musical note to be produced; and a data conversion circuit for selectively producing, in response to the timing of the envelope waveshape calculation, a plurality of data corresponding to one data from said generating means and each one of said plurality of data having a different change characteristic.

11. An envelope generator according to claim 1, further comprising a first buffer memory for temporarily storing envelope data to be calculated; a second buffer memory for temporarily storing envelope data read out from said first buffer memory and calculated by said calculating means; and second readout means for repeatedly reading out the calculated envelope data from said second buffer memory at a rate different from the calculation rate of said calculating means.

12. An envelope generator according to claim 1 wherein said control information generating means comprises third memory means for storing information of a switch for selectively generating the envelope of the musical note and the tone control envelope for changing the tone of the musical note with time; fourth memory means for storing information of the voltage of a variable resistor for controlling one of the rise and fall time of said envelope of the musical note and said tone control envelope; second converting means for converting the information from said fourth memory means into a desired change characteristic; and third readout means for selectively reading out, on a time divided basis, one of the speed parameter from said first memory means and the information from said fourth memory means in accordance with information from said second and said third memory means.

13. An envelope generator according to claim 12, further comprising a third buffer memory for temporarily storing output read out by said third readout means; and fourth readout means for selectively reading out said third buffer memory in accordance with the phase of the envelope and the information of one of a key depression and a key release.

14. An envelope generator according to claim 12, wherein a predetermined number is added to said tablet switch of each musical tone to be produced, and which further comprises fifth readout means for reading out said first and second memory means in accordance with said predetermined number.

15. An envelope generator according to claim 12, further comprising selecting means for selecting a speed parameter for reducing an attenuation time of the envelope of the sound to be produced.

* * * * *